US008206057B2

(12) United States Patent
Setzer et al.

(10) Patent No.: US 8,206,057 B2
(45) Date of Patent: Jun. 26, 2012

(54) TRAIL MARKING SYSTEM AND METHOD

(76) Inventors: Andy Setzer, Sherrills Ford, NC (US); Randy Frye, Lincolnton, NC (US)

( * ) Notice: Subject to any disclaimer, the term of this patent is extended or adjusted under 35 U.S.C. 154(b) by 131 days.

(21) Appl. No.: 12/797,881

(22) Filed: Jun. 10, 2010

(65) Prior Publication Data

US 2010/0316443 A1 Dec. 16, 2010

Related U.S. Application Data

(60) Provisional application No. 61/186,149, filed on Jun. 11, 2009.

(51) Int. Cl.
*E01F 9/011* (2006.01)

(52) U.S. Cl. ..... 404/9; 116/209

(58) Field of Classification Search ..... 404/9, 10, 404/12–16; 116/63 C–63 T, 209
See application file for complete search history.

(56) References Cited

U.S. PATENT DOCUMENTS

| | | | | |
|---|---|---|---|---|
| 2,417,384 | A * | 3/1947 | Switzer | 250/462.1 |
| 3,091,215 | A * | 5/1963 | Kenmore | 116/173 |
| 3,824,748 | A * | 7/1974 | Pichowicz | 52/103 |
| 5,435,663 | A * | 7/1995 | Suhr | 404/14 |
| 6,165,609 | A * | 12/2000 | Curatolo | 428/343 |
| 2005/0117968 | A1 * | 6/2005 | Nielsen | 404/10 |
| 2006/0102251 | A1 * | 5/2006 | Kemmesat | 144/347 |
| 2007/0237578 | A1 * | 10/2007 | Boyd | 404/14 |
| 2009/0308001 | A1 * | 12/2009 | Wu et al. | 52/173.3 |

* cited by examiner

*Primary Examiner* — Raymond W Addie
(74) *Attorney, Agent, or Firm* — Clements Bernard PLLC; Seth L. Hudson

(57) ABSTRACT

A plurality of biodegradable stakes for use as trail markers that are coated with a biodegradable coating comprised of an adhesive and a fluorescing compound for inserting into the ground such that the coated surface of the marker is exposed at various distances from each other such that the stakes glow when a source of ultra-violet light is present and thus form a route or trail by which a person can find their way to a point of interest even in low light conditions, while remaining unobtrusive so that one has difficulty seeing the stake without ultraviolet light and unless one is specifically looking for it thereby not detracting from the natural appearance of the location.

17 Claims, 4 Drawing Sheets

TRAIL MARKING SYSTEM AND METHOD

CROSS REFERENCE TO RELATED APPLICATION

This application claims priority to U.S. Provisional Patent Application Ser. No. 61/186,149 filed 11 Jun. 2009, entitled "Trail Marking System and Method", which is incorporated by reference herein for all purposes.

BACKGROUND OF THE INVENTION

This invention generally pertains to a novel composition and method for marking trails that utilizes a bio-degradable, fluorescing coating that is coated onto wooden stakes for use in marking or staking a path through woods, fields, or any land area where persons are likely to travel to and from a particular location.

Hunters, fisherman, and outdoor enthusiasts often seek to travel to places and spots in wilderness areas in order to take advantage of what these places offer. These places and areas can be remote, and typically are not easily accessed. More often than not, these remote areas can be accessed only by off-road vehicles, horseback, or foot. Consequently, most of these places and spots do not experience large crowds of people. Because these places and spots are not heavily accessed, often there are no roads, paths, or reliable markings indicating how to find the place or spot.

Due to the remote nature of these places and spots, often they make for ideal places from which to hunt, fish, observe wildlife, or other activity wherein isolation and quiet is desired. For example, when hunting, a hunter will typically seek out an isolated spot from which to hunt. This is desirable for several reasons. When most animals roam in the woods, they tend to avoid places where large groups of people can be found. Also, most wild animals avoid places where people tend to congregate. For example, deer often times will not approach a location if they smell that people are there or have recently been there. The deer prefer to remain deep within the woods. Remaining in the woods provides them with cover and is home to their food and water supply. As such, a deer hunter typically needs to traverse through woods or fields in order to find the deer that are deep within the woods. Moreover, since noise from human activity typically scares wild animals, including deer, it is advantageous to travel as deep into the wilderness and as far away from other human activity as possible.

In addition to hunters, others who are interested in encountering wildlife will seek out places and spots deep within a wooded area. For example, photographers who desire to photograph deer or other animals in their natural habitat need to venture deep into the woods in order to find the animals. Often times this will involve the person seeking out a path into the woods or simply heading into the woods in a random direction seeking out a spot from which they may observe wild animals.

This desire of hunters, sportsmen, and the like, to venture off the beaten path and deep into the woods, is not free from peril. There are and have always been stories of people who have wandered into the woods or other wilderness areas and become lost. Depending on the circumstances and area in which a person becomes lost, becoming lost in the woods can result in serious injury or death. Therefore, it can be dangerous for one to wander into the woods without knowledge of the woods and of where they are going. Sometimes, even if a person is familiar with the areas in which they are going, problems can still arise. For example, it is very possible to become stranded by changing weather conditions. Rapidly moving thunderstorms, flash floods, snowstorms, and even perhaps fog can change a familiar landscape into unfamiliar terrain.

Thus, the innate dangers of entering the woods, wilderness, or other remote areas have given rise to a need for products, devices, and methods to prevent people from becoming lost. A need exits for a people to be able to find their way out of the wilderness once they have ventured within. Moreover, once a person has visited a particular spot, he or she may wish to return to that specific spot. Thus a need exists for products, devices, and methods for a person to be able to retrace their steps and return to a favorite spot.

In addition to the desire of hunters, sportsmen, and the like to enjoy the outdoors through activities like hunting, fishing, and hiking, many people are realizing the health benefits of hiking and are beginning to hike in the woods and wilderness areas. Recently, people are becoming more aware of the potential detrimental effect on the environment of large numbers of people frequenting a particular area. Many people are becoming more aware of and concerned with minimizing their impact on the environment. When multiple people walk through the woods in the same spot, pathways develop. Since pathways are typically where vegetation is worn away and cannot grow, largely due to people or animal traffic, creation of a path has a detrimental impact on the environment; it stops growth where normally growth would occur. Thus, creation of a path to a particular spot in the wilderness is undesirable. However, a path is generally the way a person finds his or her way back to a particular spot. Without a path it can be difficult to remember how to get to the desired spot. As such a need exists for a device and method by which a person can find their way to and from a spot in a wilderness area that has a minimal effect on the environment.

Many products and devices now exist that aid persons in their ventures within remote woods, wilderness areas, and other locations. The most obvious example, and one of the simplest, is a compass. A compass, in its simplest form, is designed to always point toward magnetic North (in the northern hemisphere) such that a person need only look at the needle to determine in which direction North lies. Armed with this information, if a person is familiar with the area or has a map, they can usually find their way to a location using the cardinal directions (North, South, East, and West). However, this provides only information on the general direction a person is traveling and does not provide guidance on a person's actual location. The ability to find a particular spot using only a compass and a map takes appreciable skill. Indeed, the sport of orienteering has developed for people to compete in their ability to locate a particular spot using only a map and compass.

Over the years the technology and design of a compass has greatly improved. Currently, a person is able to purchase a global positioning system (GPS) that uses satellites to pinpoint a person's location on the surface of the earth to within approximately 10 feet. While this is amazingly accurate information, there are still problems that need to be overcome that a GPS simply cannot defeat. First, a GPS must be powered. Therefore, one must use batteries, solar charges, or another power source to power the GPS unit. Also, a GPS is only good and will only work when the satellites are accessible. If the reception of the GPS is not good, due to potential cover such as clouds or very dense tree cover, reception may be lost and the functionality of the GPS unit reduced to zero. If a person is relying only on a GPS to guide them, and the GPS becomes inoperable for any reason, the person is left with a useless device.

Moreover, a GPS unit can be bulky and unwieldy to carry. This is compounded by the fact that most people, when traveling in the woods or any wilderness or less traveled area, will have certain gear they are bringing with them. For example, hunters will typically have a firearm or bow, and photographers will typically have a camera, lenses, and film. While advances in materials have reduced the size and weight of guns, bows, cameras, etc., the fact remains that a person still has to carry the items into the wilderness area with them. Use of a backpack helps with some of this, but backpacks can be unwieldy. Typically a hunter or photographer strives to maintain flexibility and a certain freedom of movement in order to reduce any noise they may make that would scare away wildlife. Thus, while a GPS unit is quite handy and a useful device, it is still yet another item that the person traveling into the woods must deal with. As such, GPS units, while useful, still have a myriad of problems that need to be overcome.

Perhaps one of the best solutions to the problem of marking a trail or path into a wilderness area comes in the form of a simple roll of tape. There are numerous products on the market that are essentially trail marking tape. A person will go into the woods and periodically tear off a piece of tape and place it on a tree or rock in a visible location. Thus, when the person is entering or leaving the area, he or she simply needs to follow the bread-crumb trail of tape.

Trail marking tape has undergone advances much like the compass. Currently, tape is available that is manufactured so as to have reflective properties, much like reflectors placed on bicycles, cars, boats, etc. This reflective property of the tape allows the person searching for the tape to easily spot the tape in the woods even in lower light conditions. There are even phosphorescent paints that can coat the tape such that it will glow for a time after the sun sets. The use of tape is, however, fraught with problems that need to be overcome.

Tape can be harmful to the environment in which it is placed. Often tape is coated with an adhesive that contains chemicals that are harmful to the environment. Tape is manufactured to be strong and therefore can last for years. While this may be advantageous in that one would desire the tape to last, the overall impact on the environment is negative. Since many people enjoy the woods and remote places for the natural beauty, lots of tape showing up on trees and rocks is undesirable.

Another method people have devised to mark trails in and out of secluded areas is simply to place thumbtacks into trees along the way. Like tape, however, the use of thumbtacks can be problematic. Most thumbtacks are metal and, therefore, can rust. Also, thumbtacks tend to be small and difficult to see, especially in lower light conditions. Further, the use of multiple thumbtacks in the wilderness can detract from the esthetic appeal much like the over use of tape. Thus, a need exists to overcome the limitations of thumbtacks as well.

An additional problem with the use of tape, thumbtacks, or any readily visible marker is that anyone can see it. Hunting and fishing have become competitive in recent years due in large part to the increase in the numbers of people enjoying these activities. As such, the competition for the best spots is sometimes fierce. If a person finds a favorite spot and wants to mark a trial to the spot so that they can find it again, the use of tape, thumbtacks or any visible marker will alert other people to their find. This can be especially important for hunters, where there is always a risk of stray bullets.

While most areas used in hunting are remote and not heavily accessed, there are places where a large number of hunters typically gather. For example, state game lands attract a large number of hunters. Thus, hunters who find a favorite spot in which to hunt, or even set up a hunting blind or stand, need a way to find their spot or blind that other hunters are not likely to follow. This is especially true in peak hunting times such as the first few days of the season or "doe" days in which many hunters are in the woods. However, typical prior art methods of marking trails allow anyone who is in the vicinity of the marked trail to easily see and potentially follow the marked path. Thus, a need exists for a device and method of marking a trail that is easy for the person who finds the spot to use, yet is not easily apparent to one who is not familiar with the trail.

Several US patents have issued that relate the present invention. However, none of these patents discloses the beneficial and novel aspects of the present invention. For example, U.S. Pat. No. 5,000,111 to Gibson discloses and teaches a trail marking device for marking a trail and guiding an individual who is retracing his steps in a wooded area during daylight or darkness. The device taught by Gibson has a long sheet of light reflecting material that is easily seen in the daylight. Abutting the long sheet is a strip of luminescent material which can be more easily viewed in darkness. Gibson discloses several longitudinally spaced, longitudinally aligned wire sections that are sandwiched between the strips for securing individual sheet sections to a tree limb. The sheet sections are detachably coupled to adjacent sheet sections along perforated break lines. Gibson also teaches that the strips are wound on a spool which includes a plurality of tacks which can be used for alternately tacking the strips to a tree. This system requires that the marker remain visible to anyone who happens to be looking toward it. Also, this system requires attachment to a tree. As such, the impact on the environment is significant. Not only is there a detrimental effect of placing these markers on trees, but there remains unsightly markers that are easily seen by others when in the wilderness.

U.S. Pat. No. 5,669,327 to Beebe discloses and teaches a system for marking trails that includes a visible tag. The visible tag has a unitary body of a planar configuration. The tag is made to have a highly visible color with the body of the tag being made of a biodegradable plastic material. Beebe teaches that to use the system, several tags are fastened to foliage at regular intervals along a trail to provide a series of visible markers which define the trail. Beebe teaches that the tags are retrieved for reuse after the tags have served their intended purpose. A problem inherent to the system disclosed by Beebe is that the markers remain highly visible to anyone who is walking nearby in the wilderness. Indeed, the tags taught by Beebe are designed to be highly visible in the wilderness. Further, the tags are designed to be attached to vegetation along the desired route. Thus, there is an impact on the surrounding environment.

U.S. Pat. No. 6,299,379 to Lewis discloses and teaches a reflective trail marker which may be used to form an outdoor trail. The marker is designed to be highly visible at night. Lewis teaches that the reflective trail marker has a generally "hour-glass" shaped marker head. On the marker head is a central portion and top and bottom cap portions. The central portion has a light reflective side wall surface. The top and bottom cap portions have non-reflective surfaces, and preferably overhang the reflective side wall surface of the central portion. Lewis discloses that the reflective trail markers may be attached to horizontal support structures, for 360° reflection. Lewis teaches that this is in order to mark a trail easily visible at night when a light is shined on the trail from any angle. Also, Lewis teaches that the trail marker may be attached to vertical support structures, for limited angle reflection, to form a secret trail. Lewis states that the marker can be placed vertically such that the top and bottom shade a portion of the reflective surface. In order to detect the marker, the light must be shown onto the marker at a particular angle in order to contact the reflective material. Lewis claims that the trail is secret because one must know to shine the light at a particular angle in order to detect the trail. Lewis also discloses a metal pin that extends from the bottom cap portion to allow easy attachment and removal of the marker from a tree or other support structure. A problem with the disclosure of Lewis is that a person who is shining light from varying angles will be able to detect the markers if they shine the light at varying angles. Also, if one person is shorter or taller than the person who placed the markers, the light would be able to detect the trail markers. In addition, the trail markers are designed to be removed from the trail.

U.S. Pat. No. 7,301,469 to Hoffman et al. ("Hoffman") discloses and teaches an electronic trail marking system operated by a remote control. The system has multiple trail markers and a remote control handset. The handset controls and can activate the trail markers. The invention also includes a setting tool for setting and removing the trail markers. To use the trail marking system, a hunter attaches a trail marker into a tree using the setting tool. The trail markers contain externally perceivable indicators that can be selectively turned on an off with the remote control. When the indicators in the trail markers are off, the trail markers are inconspicuous. However, when the indicators are activated, they are highly visible. As such, a hunter can selectively turn on and off the trail markers as he/she walks along the trail. Several problems exist with this invention however. The trail markers require attachment to the foliage. Additionally, the user must carry a remote control to activate the markers. Additionally, the markers must have a source of power which is typically a battery. The battery will require replacing when the charge has been consumed.

A need therefore exists for a device and method that overcomes the limitations of the prior art, yet meets the demands of the modern hunter and outdoor enthusiast. Moreover, a need exists for a trail marking device that is not harmful to the environment and that can be difficult to see or hidden from other people. The present invention solves the problems of the prior art and provides such a device and method.

BRIEF SUMMARY OF THE INVENTION

The present invention is generally directed to a trail marking system in which a biodegradable stake is coated with biodegradable coating. The biodegradable coating is fluorescent, and is easily seen when ultra-violet light makes contact. The present invention is further directed to a method of marking a trail wherein one utilizes multiple biodegradable stakes that are coated with a fluorescent coating. The stakes are inserted into the ground such that the coated surface is exposed. The stakes are inserted into the ground at various distances from each other such that they form a trail by which a person can find their way to a point of interest. The stakes and coating are biodegradable so that when abandoned they will decompose and not harm the environment. The stakes are placed in unobtrusive locations that are typically difficult to see unless one is looking for them. The location is chosen such that the glow effect when the coating fluoresces will be easily seen by one who is shining a blacklight flashlight or other source of ultra-violet light.

The present invention is more specifically directed to a device for use in a trail marking system comprising a biodegradable stake and a fluorescent coating. The fluorescent coating is applied to the stake. The fluorescent coating is also non-toxic and biodegradable. The present invention further contemplates the stake having a first end and a second end at the opposite end of the stake from the first end. The first end is sharpened and terminates in a point. This aids in inserting the device into the ground and allows the device to stand upright when placed into the ground. As such, the device can remain stationary by being held in place by the ground.

The present invention further contemplates utilizing a fluorescent coating that is an adhesive. The fluorescent coating is a mixture of a fluorescing compound and an adhesive. The invention contemplates applying the fluorescent coating to only a portion of said stake. The coating can be applied to the stake so that approximately 5 inches of the stake are coated with the fluorescing coating. However, the present invention also contemplates that the fluorescent coating can be applied to the entire surface area of said stake.

The present invention can be manufactured from a variety of materials, as long as the materials will not harm the environment. For example, the present invention contemplates that the stake be made from wood. Also, the present invention also contemplates that the stake could be made from plastic or from rubber. The size of the stake can vary depending on the application and intended location of the stake. In a preferred embodiment, ¼ inch wood is used for the stake.

The present invention is also directed to a method of marking and following a trail. The method includes providing a plurality of trail marking devices comprising a biodegradable stake and a fluorescent coating applied to the stake, wherein the coating is biodegradable. The method also includes placing a first trail marking device at a particular point and placing a second trail marking device at a particular point spaced from the first trail marking device. The method also includes placing a third trail marking device at a particular point spaced from the second trail marking device and the first trail marking device. Thus, the first, second, and third trail marking devices define a route. One can follow the stakes like a breadcrumb trail to find the point of interest. The present invention further contemplates that the trail marking devices may be placed by inserting the device into the ground. Further, the trail can be marked so that unless one knows of its presence, it will be hard to detect by placing the trail marking devices in inconspicuous locations.

The present invention further contemplates a method of marking and following a trail in low light conditions. The method includes shining ultra-violet light toward a first trail marking device at a specific location. The ultra-violet light will contact the fluorescent coating on the stake and causing the first trail marking device to fluoresce. When the person sees the fluorescing stake, he or she moves to the location of the first trail marking device. Once there, the person shines ultra-violet light toward a second location spaced apart from the first location. When the ultra-violet light contacts the second stake, it will cause the second trail marking device to fluoresce, and the person can move to the location of the second trail marking device. The person repeats these steps, following the route defined by the fluorescing stakes until a final location is reached.

The present invention is still further directed to a compound for use as a coating in a trail marking system. The compound is comprised of non-toxic, biodegradable glue and a fluorescing, biodegradable compound. The present invention contemplates and has been found to work particularly well with Gorilla Glue and Elmer's Glue. The present invention further has been found to work particularly well where the fluorescing compound is Scanning Compound #7 (SC-7) from Angstrom Technologies, Inc. In addition, the present invention works well where the fluorescing compound is DC-109GY Green-Yellow Daylight Fluorescent Dye, also available from Angstrom Technologies. The present invention contemplates using the fluorescing compound is a concentration of approximately 0.5% to 40% by weight. In a more preferred embodiment, the fluorescing compound is present in a concentration of approximately 1% to 5% by weight. These combinations result in a fluorescing coating that is clear and blends in with the color of the stake, thus making the trail marking device difficult to see without the use of a source of ultra-violet light.

BRIEF DESCRIPTION OF THE DRAWINGS

The present invention is illustrated and described herein with reference to the various drawings, in which like reference numerals denote like method steps and/or system components, respectively, and in which.

DETAILED DESCRIPTION OF THE INVENTION

In various exemplary embodiments the present invention provides a device and method for marking trail systems. More specifically, the present invention provides a novel chemical suspension that has advantageous properties over the prior art and is used to coat biodegradable stakes for use in the environment. The novel chemical suspension is fluorescent and will glow when a source of ultra-violet light is present. The suspension is used as an adhesive coating on the stakes, and the stakes are strategically placed such that they mark a path to a location. The stakes are advantageously placed in obscure locations that will not be easily seen by anyone not specifically looking for the stakes. As the stakes can glow when ultraviolet light is shined on them, a person can find their way by following the stakes even at night or in very low light conditions.

The following detailed description of the preferred embodiment(s) is merely exemplary in nature and is in no way intended to limit the invention, its application, or uses. It can be readily appreciated by those skilled in the art that the following detailed description illustrates and describes only one preferred embodiment of the present invention. As such, the following detailed description should not be considered as limiting in any manner the disclosed invention.

Figure 1:
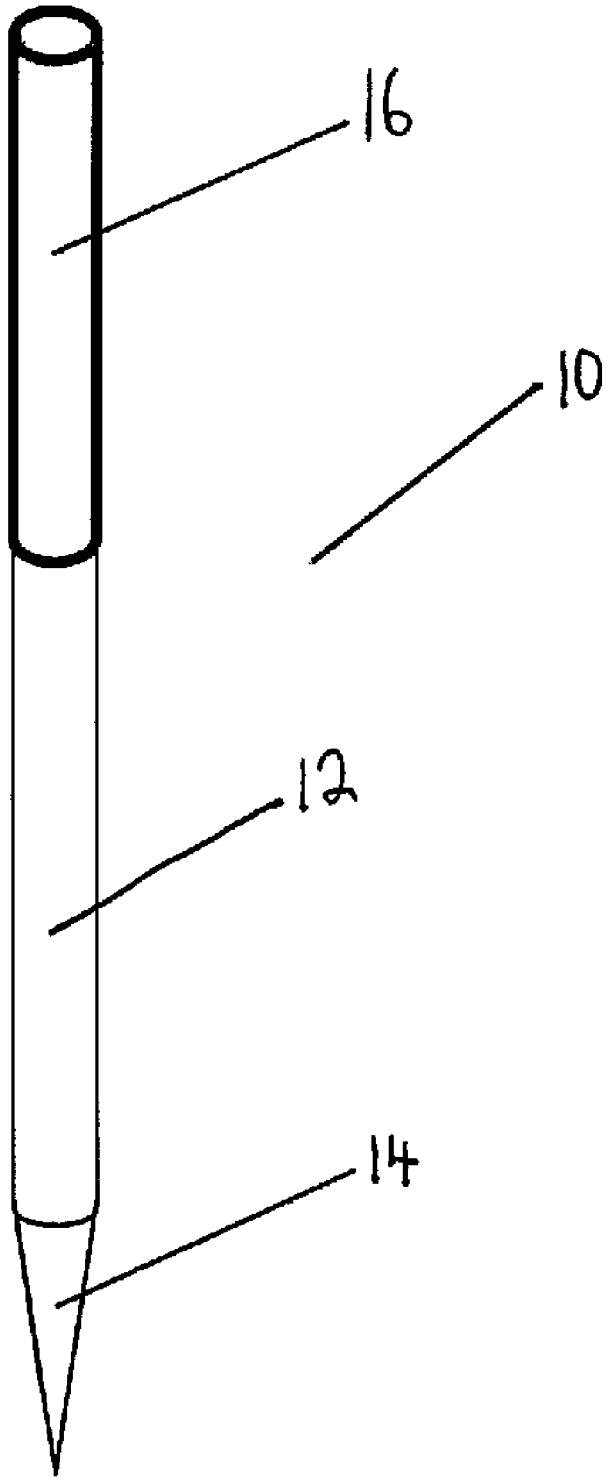
FIG. 1 is a perspective view of the present trail marking apparatus.

Referring to FIG. 1, the trail marking device 10 is shown. The trail marking device 10 is generally comprised of a biodegradable stake 12 with a sharpened point 14. The stake 12 can be made of any biodegradable material or combination of materials such as wood, paper, cardboard, or the like. The stake 12 is provided with a sharpened point 14 to facilitate inserting the stake into the ground. The sharpened point 14 is optional, depending on the thickness of the stake 12. If the stake 12 is thin enough for insertion into the ground without the need for a sharpened point, then the device 10 may be manufactured without the sharpened point 14. Likewise, if the device 10 is manufactured solely to mount in a bush or a tree, the sharpened point 14 is not necessary.

The stake 12 is coated with a biodegradable, fluorescing coating 16, such that the coating 16 glows when it is exposed to a source of black light or other ultra-violent light. The coating 16 coats the stake 12 only as much as is necessary to provide a readily visible glow when the ultra-violet light is present. In a preferred embodiment, the coating 16 is spread on approximately the top one-third of the stake 12. However, it is contemplated that the coating 16 could only cover a small portion of the stake 12, or it could cover the entire stake 12.

Figure 2:
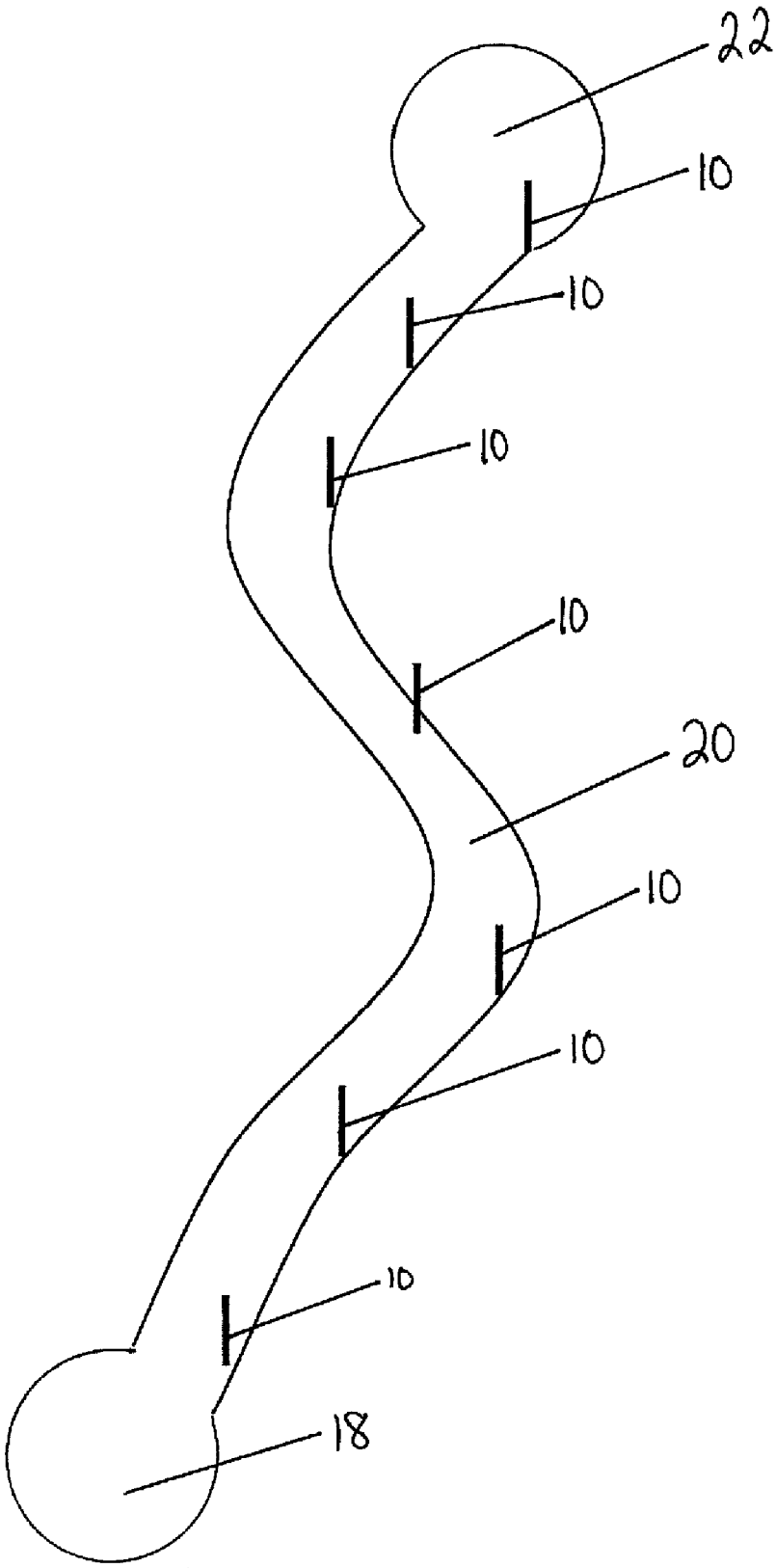
FIG. 2 is a top view of the present trail marking invention in use.

Referring now to FIG. 2, the method of the present invention is illustrated. A starting point 18 is determined for the trail to be marked. Typically the starting point 18 will be the location from which a person will travel to reach a destination. As the person travels from the starting point 18 he or she will place a trail marking device 10 into the ground at various distances. Repeated placement of a trail marking device 10 will define a path 20 commencing at the starting point 18. The person will travel, continually placing trail marking devices 10 into the ground, until he or she reaches the destination point 22. It is contemplated that the person will place the device 10 in a spot in the ground that is not easily seen unless one knows where to look. This way the average person walking through the woods will not see the device 10 unless he or she is specifically looking for it. Upon reaching the destination point 22, the placement of the trail marking devices 10 has formed a marked path 20 by which the person can travel from the starting point 18 to the destination point 22 and back again. The trail marking devices 10 will fluoresce when exposed to an ultra-violet light source. Thus, a person can shine a black light to find the markers along the path 20. During dusk, dawn, night or in any low-light condition, the person will use a source of ultra-violet light to detect the path 20. Moreover, if placed in an inconspicuous location, the trail marker devices 10 will be difficult to see with the naked eye.

Figure 3:
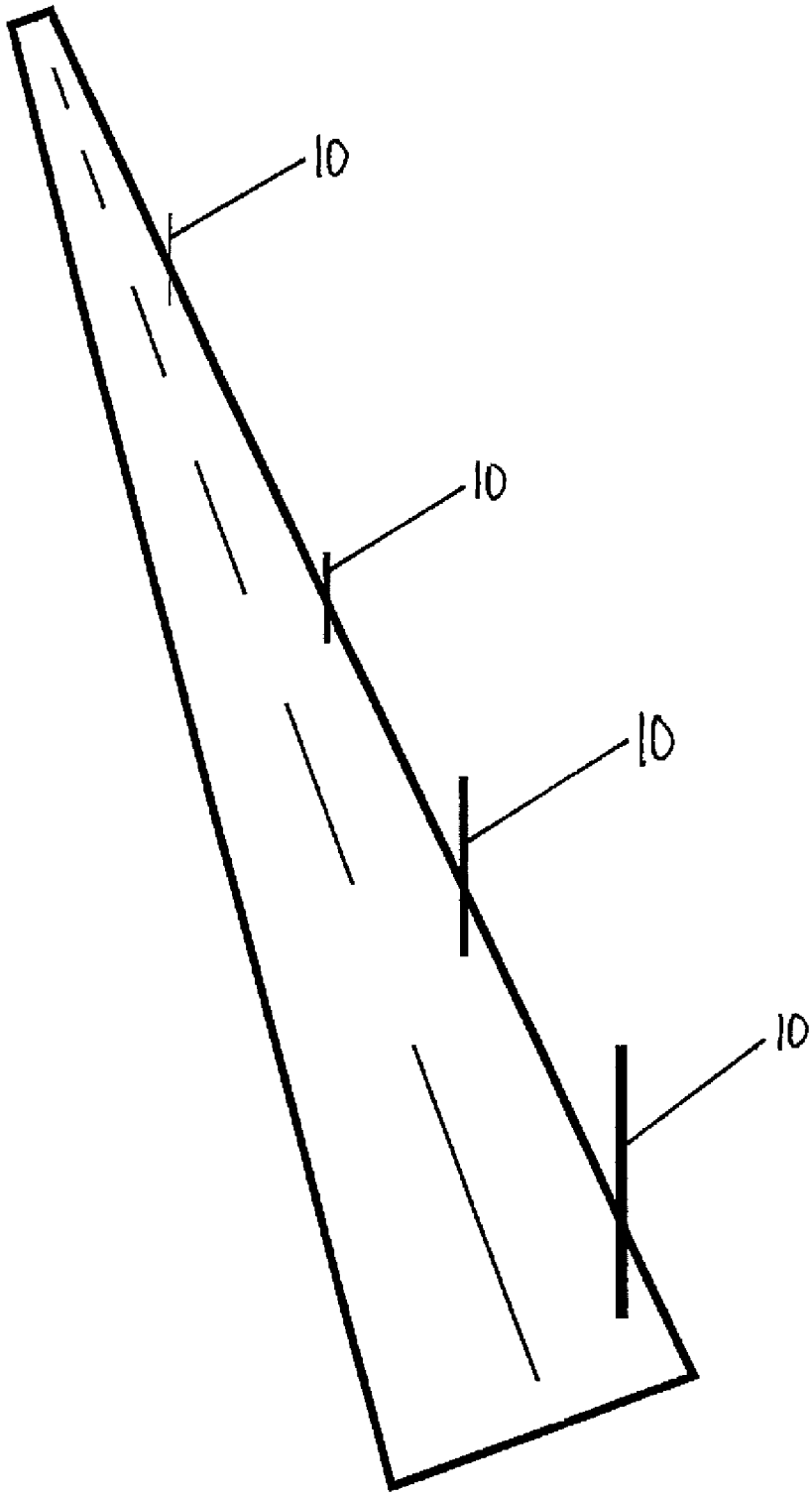
FIG. 3 is a perspective view of the invention used to mark a path down a road.
Figure 4:
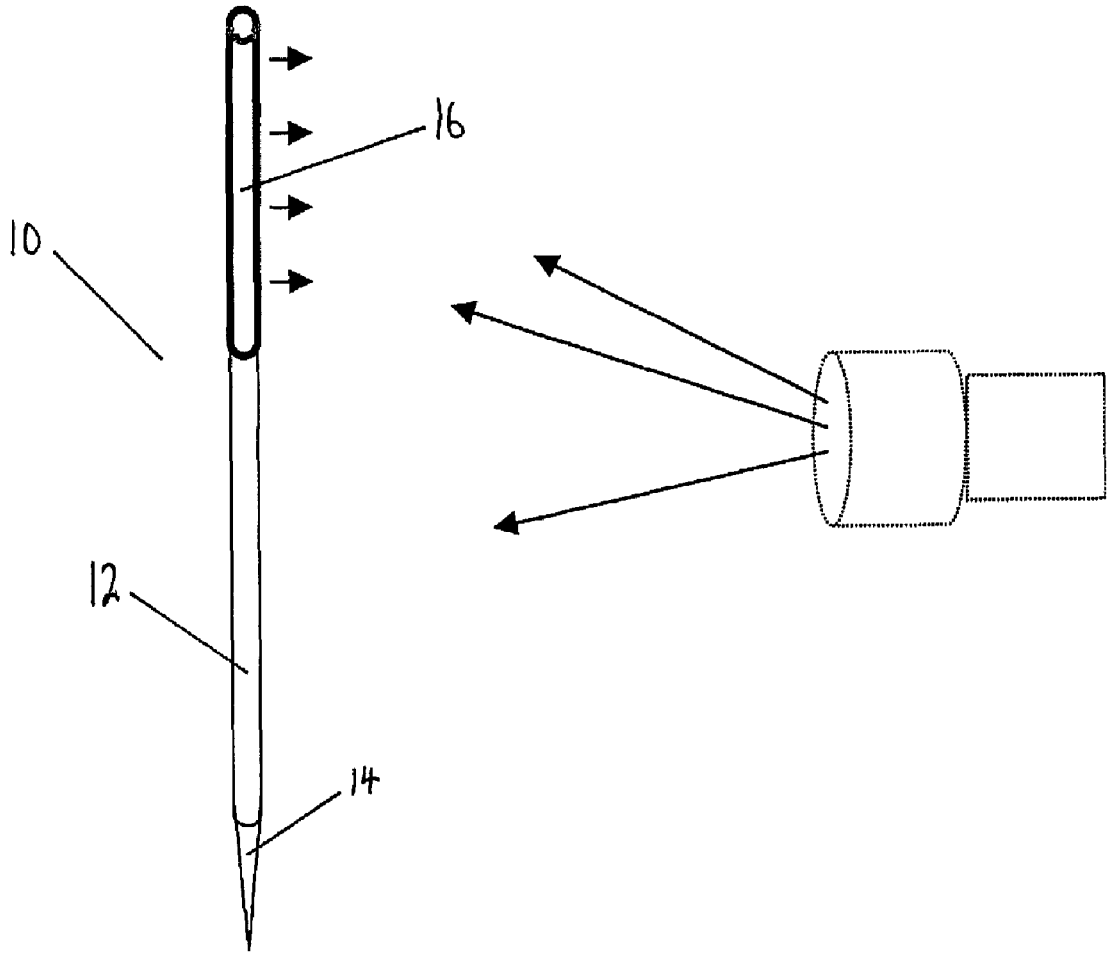
FIG. 4 is a perspective view of the present invention showing the fluorescence of the invention when exposed to a source of ultraviolet light.

Referring now to FIGS. 3 and 4, the use of the present invention is illustrated. FIG. 3 shows the present invention used along a roadway. The trail marker device 10 is present at intervals along the road. It can easily be seen that the trail marking device 10 can be used to mark any number of pathways, roads, right of ways, or other items that would typically be marked by a bread-crumb type trail marker. As the user of the trail marking device 10 approaches where the device 10 should be located, he or she shines a source of ultra-violet light in the general vicinity of the trail marking device 10. Once the ultra-violet light is in a close enough proximity to the trail marker device 10, the light will contact the coating 16 and it will fluoresce. The user will then move toward the fluorescing trail marker device 10, thereby continuing down the path 20. Once the user has moved past the fluorescing trail marker device, the user will begin to look for the next trail marker device 10. The user will repeat these steps until he or she has reached the final trail marker device 10 and arrived at the desired location.

The present invention also pertains to a novel combination of chemicals that comprise the biodegradable, fluorescing coating 16. In a preferred embodiment, one of the components of the present invention is a general, non-toxic, biodegradable glue. Two types of glue that have been found to work very well are Gorilla Glue and Elmer's School Glue, which has been used safely by elementary school students for years. The glue is non-toxic and readily available. Moreover, the glue is relatively inexpensive and has sufficient adhesion properties to maintain its adherence to the stake 12. In addition, the combination of the glue with the fluorescing chemical results in a suspension that is colorless. When applied to the stake 12, the fluorescing coating appears as a colorless substance. Thus, the natural color of the stake 12 is partially visible under the fluorescing coating 16. While one skilled in the art can readily appreciate that any number of different adhesives can be used, care must be taken to select an adhesive that will not harm the environment yet will be tacky enough to adhere to the stake 12.

The fluorescent coating 16 is further prepared by blending into the glue a non-toxic, fluorescing compound. In a preferred embodiment, this compound is available as Scanning Compound #7 (SC-7) from Angstrom Technologies, Inc, and/or DC-109GY Green-Yellow Daylight Fluorescent Dye, also available from Angstrom Technologies. The compound SC-7 is blended with the glue until it is completely immersed in the glue forming a suspension. Typically, the amount of the fluorescing compound used is from about 0.5% to 40% by weight. In a preferred embodiment, the amount of compound used in the glue is from about 1% to 5%. The suspension which constitutes the fluorescing coating 16 is then applied by conventional methods to the stakes 12. In a preferred embodiment, the stake 12 is adapted to be coated with approximately five inches of suspension (fluorescing coating 16), thus ensuring that the stake will be easily visible after insertion into the ground when exposed to ultra-violet light. After coating with the fluorescing coating 16, the stake 12 is air dried for approximately a twenty-four hour period. It is contemplated, however, that any conventional drying technique can be used.

As is readily appreciated by those skilled in the art, the stake 12 can be made of any biodegradable material. In a preferred embodiment, the stake is made of wood. Wood is a strong yet lightweight material that is readily available. Many types of wood can be utilized to make the stake 12. The wood provides a surface to which the fluorescing coating 16 can easily adhere and does not require any heating to facilitate adhesion. Moreover, over time the wood stake 12 will decompose in the environment along with the fluorescing coating 16 leaving no trace of the invention. Thus, the invention will not harm the environment.

One skilled in the art can readily appreciate that additional components may be added to the suspension. For example, various stabilizers or pigments may be added. While an object of the invention is to provide an unobtrusive marker for a trail, it is readily appreciated that a color can be added to the suspension such that the marker has a color and is readily visible. Thus, the trail marker 10 can include a vibrant color such that it is not only visible when exposed to an ultra-violet source, but it is visible by the naked eye.

Although the present invention has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

We claim:

1. A device for use in a trail marking system comprising:
a biodegradable stake,
a fluorescent coating applied to said stake, wherein said coating is biodegradable and comprises:
a non-toxic, biodegradable adhesive, and
a fluorescing, biodegradable compound in an amount from about 0.5% to about 40% by weight of the fluorescent coating.

2. A device according to claim 1 further comprising:
a first end,
a second end spaced at the opposite end of said stake from said first end wherein said first end terminates in a point.

3. A device according to claim 1 wherein said fluorescent coating is applied to only a portion of said stake.

4. A device according to claim 1 wherein said fluorescent coating is applied to the entire surface area of said stake.

5. A device according to claim 1 wherein said stake is made from wood.

6. A device according to claim 1 wherein said stake is made from plastic.

7. A device according to claim 1 wherein said stake is made from rubber.

8. A method of marking and following a trail comprising:
a) providing a plurality of trail marking devices comprising a biodegradable stake and a fluorescent coating applied to said stake, wherein said coating is biodegradable, and comprises:
a non-toxic, biodegradable adhesive, and
a fluorescing, biodegradable compound in an amount from about 0.5% to about 40% by weight of the fluorescent coating,
b) placing a first trail marking device at a particular point,
e) placing a second trail marking device at a particular point spaced from said first trail marking device,
f) placing a third trail marking device at a particular point spaced from said second trail marking device and said first trail marking device such that said first, second, and third trail marking devices define a route.

9. A method according to claim 8 further comprising placing a trail marking device by inserting said device into the ground.

10. A method according to claim 8 further comprising placing a trail marking device in an inconspicuous location.

11. A method according to claim 8 further comprising:
a) shining ultra-violet light toward a first trail marking device at a specific location causing said first trail marking device to fluoresce;
b) moving to said first trail marking device;
c) shining ultra-violet light toward a second location spaced apart from said first location causing a second trail marking device to fluoresce;
d) moving toward said second trail marking device;
e) repeating steps d) and e), thus following said route, until a final location is reached.

12. A compound for use as a coating in a trail marking system comprising:
a non-toxic, biodegradable glue, and
a fluorescing, biodegradable compound in an amount from about 0.5% to about 40% by weight of the coating.

13. A compound according to claim 12 wherein said non-toxic, biodegradable glue is Gorilla Glue.

14. A compound according to claim 12 wherein said non-toxic, biodegradable glue is Elmer's Glue.

15. A compound according to claim 12 wherein the fluorescing compound is Scanning Compound #7 (SC-7) from Angstrom Technologies, Inc.

16. A compound according to claim 12 wherein the fluorescing compound is DC-109GY Green-Yellow Daylight Fluorescent Dye, available from Angstrom Technologies.

17. A compound according to claim 12 wherein the fluorescing compound is approximately 1% to 5% by weight of the compound.

* * * * *